US011818548B2

(12) United States Patent
Paludan-Müller

(10) Patent No.: US 11,818,548 B2
(45) Date of Patent: Nov. 14, 2023

(54) METHOD OF OPERATING A BINAURAL EAR LEVEL AUDIO SYSTEM AND A BINAURAL EAR LEVEL AUDIO SYSTEM

(71) Applicant: WIDEX A/S, Lynge (DK)

(72) Inventor: Carsten Paludan-Müller, Lynge (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 17/760,972

(22) PCT Filed: Sep. 28, 2020

(86) PCT No.: PCT/EP2020/077075
§ 371 (c)(1),
(2) Date: Mar. 16, 2022

(87) PCT Pub. No.: WO2021/063873
PCT Pub. Date: Apr. 8, 2021

(65) Prior Publication Data

US 2022/0337961 A1 Oct. 20, 2022

(30) Foreign Application Priority Data

Sep. 30, 2019 (DK) ..... PA201901139

(51) Int. Cl.
*H04R 25/00* (2006.01)

(52) U.S. Cl.
CPC ..... *H04R 25/552* (2013.01); *H04R 25/407* (2013.01); *H04R 25/48* (2013.01)

(58) Field of Classification Search
None
See application file for complete search history.

(56) References Cited

U.S. PATENT DOCUMENTS

| | | | | |
|---|---|---|---|---|
| 2010/0002886 | A1 | 1/2010 | Doclo et al. | |
| 2012/0008807 | A1* | 1/2012 | Gran | H04R 25/407 381/313 |
| 2013/0259239 | A1 | 10/2013 | Aubreville et al. | |
| 2015/0230026 | A1 | 8/2015 | Eichfeld et al. | |
| 2018/0091907 | A1 | 3/2018 | Long et al. | |
| 2018/0103327 | A1 | 4/2018 | Mosgaard | |

FOREIGN PATENT DOCUMENTS

| | | | |
|---|---|---|---|
| EP | 3 496 423 | A1 | 6/2019 |
| WO | 2002/03749 | A2 | 1/2002 |
| WO | 2008/006401 | A1 | 1/2008 |
| WO | 2015/157827 | A1 | 10/2015 |
| WO | 2016/004983 | A1 | 1/2016 |

(Continued)

OTHER PUBLICATIONS

Hala As'ad et al., "Binaural Beamforming with Spatial Cues Preservation for Hearing Aids in Real-life Complex Acoustic Environments", Proceedings of APSIPA Annual Summit and Conference 2017, Dec. 12-15, 2017, pp. 1390-1399.

(Continued)

*Primary Examiner* — Kenny H Truong
(74) *Attorney, Agent, or Firm* — Sughrue Mion, PLLC

(57) ABSTRACT

A method (600) of operating a binaural ear level audio system in order to improve speech intelligibility and a binaural ear level audio system adapted to carry out said method.

7 Claims, 3 Drawing Sheets

(56) References Cited

FOREIGN PATENT DOCUMENTS

| | | | |
|---|---|---|---|
| WO | 2019/086435 | A1 | 5/2019 |
| WO | 2019/086439 | A1 | 5/2019 |

OTHER PUBLICATIONS

Ina Kodrasi et al., "Microphone Position Optimization for Planar Superdirective Beamforming", ICASSP 2011, 2011, pp. 109-112.
International Search Report of PCT/EP2020/077075 dated Dec. 18, 2020 [PCT/ISA/210].
Written Opinion of PCT/EP2020/077075 dated Dec. 18, 2020 [PCT/ISA/237].
Danish Search Report of PA 2019 01139 dated Mar. 4, 2020.

* cited by examiner

| Omni-Directional | Sub-Cardioid | Cardioid | Super-Cardioid | Hyper-Cardioid | Bi-Directional |
|---|---|---|---|---|---|
| • = 1 | 1 > • > 0.5 | • = 0.5 | 0.5 > • > 0.25 | • = 0.25 | • = 0 |
|  |  |  |  |  |  |

METHOD OF OPERATING A BINAURAL EAR LEVEL AUDIO SYSTEM AND A BINAURAL EAR LEVEL AUDIO SYSTEM

CROSS REFERENCE TO RELATED APPLICATIONS

This application is a National Stage of International Application No. PCT/EP2020/077075 filed on Sep. 28, 2020, claiming priority based on Danish Patent Application No. PA201901139 filed on Sep. 30, 2019.

The present invention relates to a method of operating a binaural ear level audio system in order to optimize at least one of a directivity index in a selected direction and the presence of binaural cues. It also relates to a binaural ear level audio system adapted to carry out such a method.

BACKGROUND OF THE INVENTION

A binaural ear level audio system comprises two ear level audio devices. In this application, an ear level audio device should be understood as a small, battery-powered, microelectronic device designed to be worn in or at an ear of a user. The ear level audio device generally comprises an energy source such as a battery or a fuel cell, at least one microphone, a microelectronic circuit comprising a digital signal processor, and an acoustic output transducer. The ear level audio device is enclosed in a casing suitable for fitting in or at (such as behind) a human ear.

According to variations the mechanical design of an ear level audio device may resemble those of hearing aids and as such traditional hearing aid terminology may be used to describe various mechanical implementations of ear level audio devices that are not hearing aids. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In more recent types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids. In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids or Invisible-In-Canal (IIC). This type of hearing aid requires an especially compact design in order to allow it to be arranged in the ear canal, while accommodating the components necessary for operation of the hearing aid.

In fact a binaural hearing aid system is one example of a binaural ear level audio system. Generally, a binaural hearing aid system according to the invention is understood as meaning any system which provides an output signal that can be perceived as an acoustic signal by a user or contributes to providing such an output signal, and which has means which are customized to compensate for an individual hearing loss of the user or contribute to compensating for the hearing loss of the user. The hearing aids of a binaural hearing aid system can be worn at, on or in the ear, and may be fully or partially implanted. However, some systems whose main aim is not to compensate for a hearing loss, may also be regarded as binaural hearing aids, for example consumer electronic devices (such as headsets) provided they are binaural and have measures for compensating an individual hearing loss.

Within the present context a binaural ear level audio system consists of two ear level audio devices, one for each ear of the user. Furthermore, the binaural ear level audio system may comprise an external device, such as a smart phone having software applications adapted to interact with other devices of the ear level audio system. Thus within the present context the term "ear level audio device" may also denote a hearing aid.

Beamforming, in general, exploits the fact that spatially separated microphones receive slightly different versions of the same sound signal, due to the different propagation paths of the signals.

A monaural beamformer used in contemporary hearing aids may be realized by providing an omnidirectional signal and a bidirectional signal and combining them to provide the monaurally beamformed output signal as shown in the following equation:

$$\text{locator}=\alpha\cdot\text{omni}+(1-\alpha)\cdot\text{bidir} \quad (1)$$

Wherein "locator" represents the output signal provided by the monaural beamformer, "omni" represents an omnidirectional signal. "bidir" represents a bidirectional signal and "α" is a monaural beam forming parameter that in the present context is frequency dependent.

By varying the monaural beamforming parameter α, the omnidirectional and the bidirectional signals can be combined to make different beamformer shapes, as shown in FIG. 1 that illustrates the relative sensitivity of the combined signals with respect to all directions from 0° to 360° for different values of the monaural beamforming parameter α. Selecting α=1 results in an omnidirectional characteristic, and selecting α=0 results in a bidirectional characteristic. Some further examples of monaural beamformer shapes as a function of different values of the beamforming parameter α are also given in FIG. 1.

Thus FIG. 1 illustrates that when the monaural beamforming parameter a is not equal to one then the relative sensitivity for sound from at least some directions is suppressed and assuming that sound from these directions is undesired then noise suppression based on monaural beamforming is obtained.

The benefits that the individual user has from the availability of binaural cues may be reduced by hearing loss, aging, declining cognition function, and central auditory processing deficits. It is therefore a challenge to select a binaural beamformer setting that represents an optimum selection for most users because the individual user-related conditions need to be taken into consideration.

A binaural beamformer is realized by mixing the monaural beamformer signals from the local and opposite sides of as users head (i.e. the left and right sides, which in the following may also be denoted the ipse-lateral and contralateral sides):

$$\text{BBout}=\beta\cdot\text{locator}_{local}+(1-\beta)\cdot\text{locator}_{opposite} \quad (2)$$

Wherein "BBout" represents the output signal provided by the binaural beamformer, "$\text{locator}_{local}$" represents the output signal provided by the local (i.e. the ipse-lateral)

monaural beamformer, "$locator_{opposite}$" represents the output signal provided by the opposite (i.e. the contra-lateral) monaural beamformer and "β" is a binaural beam forming parameter, that in the present context also is frequency dependent.

This type of binaural beamforming is well known within the art of hearing aid systems. Consider now a setting wherein a is fixed to 0.25 and β is fixed to 0.5. A setting like this does give a very high directivity index (DI) at 0 degrees, but all spatial cues are lost because it is a mono signal, making the sound internalized. However, this setting also provides a directional polar pattern that is relatively narrow in the forward pointing direction (i.e. zero degrees) which is normally considered the preferred direction and while this is advantageous with respect to suppressing noise outside the preferred direction (zero degrees) then it also presents some disadvantageous effects in that just a small head movement of e.g. 30 degrees will give a large drop in sensitivity and hereby a perceived decrease in performance for most users. Furthermore, this effect is especially pronounced for frequencies around 2 kHz, which is a frequency area of high importance for speech intelligibility.

This performance degradation can be seen in both the directional polar patterns and the plots of directivity index as a function of frequency which are illustrated in FIG. 2 and FIG. 3, respectively. FIG. 2 shows directional polar patterns at approximately 500 Hz, 1 kHz, 2 kHz and 4 kHz. Note that directional polar patterns for both the left and the right side are plotted, but because the resulting binaurally beamformed signal is a mono signal then the two plots are on top of each other, which is straightforward way to illustrate that no binaural cues are present. As can be seen from the directional polar pattern for the frequency band 10 (i.e. the frequency 2006 Hz), there is a significant decrease in sensitivity for the directions 30° and 330° compared to the directly forward pointing direction of 0°.

FIG. 3 shows DI plots 300 and 301 for the directions 0° (left figure) and 30° (right figure) respectively, and both for binaural beamforming carried out with a parameter setting where α=0.25 and β=0.5. The decrease in sensitivity for 30° observed from FIG. 2 is also clearly visible in the plot of the directivity index at 30° in FIG. 3. Thus, a small head movement of 30° will give a large drop in sensitivity and therefore perceived performance if the target sound source is stationary.

However, it is known within the art of hearing aid systems that one has to choose between maintaining binaural cues and optimizing Signal-to-Noise-Ratio (SNR, i.e. the DI). For example, in Desloge et al., (1997), *Microphone-array hearing aids with binaural output. I. Fixed-processing systems*. IEEE Transactions on Speech and Audio Processing, (Volume: 5, Issue: 6, November 1997): "In one approach, filters are designed to satisfy a frequency-dependent trade between directionality and binaural cue fidelity. In another approach, the microphone signals are filtered into low- and high-frequency components with the lowpass signals providing binaural cues and the highpass signal being the single output of the array processor".

The patent application WO-A1-2015157827 is related to retaining binaural cues when mixing microphone signals. In one embodiment, a system assesses inter-aural level differences in reference subbands in order to determine suitable emphasis gains to be applied to each of one or more affected subbands.

The document WO 2002/03749 describes a microphone system using left and right microphones which produces binaural cues as well as noise reduction by using two adaptive filters.

The document US 2018/0091907 relates to binaural cue preservation in a bilateral system. This document addresses the problem that two independent automatic gain control (AGC) systems in bimodal or bilateral situation will distort binaural cues. Therefore, localization and speech understanding shall be improved in a bilateral hearing prosthesis system by linking of the AGC information between the two bilateral prostheses.

It is therefore an object of the present invention to provide an improved method for operating a binaural beamformer in a binaural ear level audio system and to provide an improved binaural ear level audio system.

A further object is to provide a binaural beamforming method that is adapted to simultaneously preserve binaural cues and optimize directivity index in at least one selected direction.

SUMMARY OF THE INVENTION

The invention, in a first aspect, provides a method of operating a binaural ear level audio device, comprising the steps of:

- providing a first and a second monaurally beamformed signal from a first and a second ear level audio device of the binaural ear level audio system;
- providing a binaurally beamformed signal by combining said first and second monaurally beamformed signal;
- using a first and a second frequency dependent parameter to control the first and the second monaurally beamformed signals, and additionally a third frequency dependent parameter to control the binaurally beamformed signal wherein said frequency dependent parameters are selected in order to provide:
- an optimized directivity index, for at least one first direction and for at least one first frequency range and an optimized presence of binaural cues for at least one second frequency range.

This method may provide directivity indices that are optimized for a plurality of directions and for a particular frequency range. Thus, the problem mentioned in the introduction that just a small head movement of 30 degrees will give a large drop in performance of the hearing aid with binaural beamforming may be solved.

It is a particular insight of the inventors of the present application that such an optimization of the directivity index in more than one direction can be obtained while maintaining binaural cues.

According to a further aspect optimization of the directivity index in more than one direction may be obtained by optimizing the sum of the directivity indices for the considered directions.

According to variations optimization of the directivity index in more than one direction may be carried out by including an optimization criterion directed at ensuring that the difference between the directivity indices for the more than one direction is minimized. According to a further variation optimization of the directivity index in more than one direction may be carried out by including an optimization criterion directed at ensuring that the directivity index for the forward pointing direction is the largest.

In a further embodiment, the values of the third frequency dependent parameter controlling the binaurally beamformed signal are constrained during the optimization. This provides a simple way to optimize the directivity index by varying freely only the first and second frequency dependent parameters during the optimization while still ensuring that binaural cues are present due to the constraining of the third frequency dependent parameter.

In yet another embodiment the strength of the binaural cues may be optimized in at least one binaural cue frequency range by varying the first, second and third frequency dependent parameter values and wherein said at least one binaural cue frequency range does not overlap with at least one directivity index frequency range, wherein said first, second and third frequency dependent parameters are varied in order to optimize a directivity index.

In summary, this invention enables a binaural ear level audio system to be personalized by allowing the specific user to select between various settings that in a very flexible manner may balance optimization of at least one directivity index against optimization of binaural cues. Hereby speech intelligibility may be improved especially in the most demanding sound environments because the binaural beamformer may be personalized to the preferences and especially the cognitive abilities (i.e. ability to improve speech intelligibility using the binaural cues) of the individual user. Thus the present invention enables an individually optimized balance between obtainable directivity and the presence of binaural cues.

Still other features of the present invention will become apparent to those skilled in the art from the following description wherein the invention will be explained in more detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects, all without departing from the invention. Accordingly, the drawings and descriptions will be regarded as illustrative in nature and not as restrictive. In the drawings.

DETAILED DESCRIPTION

In the present context the terms "binaural ear level audio system" and "binaural hearing aid system" as well as the corresponding terms "ear level audio device" and "hearing aid" may be used interchangeably because the methods of the present invention function independently on the considered systems and devices.

Furthermore, in the present context the term "direction of arrival" may also simply be denoted "direction" or "incident direction".

Figure 1:
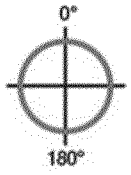
FIG. 1 illustrates a plurality of (free field) directional polar patterns provided by a monaural beamformer of a conventional hearing aid.
Figure 1:
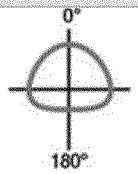
Figure 1:
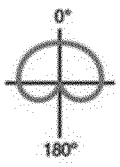
Figure 1:
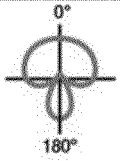
Figure 1:
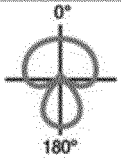
Figure 1:
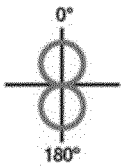

In the present context the directivity index (DI) for a particular (incident) direction is determined as the ratio (typically measured in dB) between the sensitivity at a particular direction divided by the average sensitivity for the remaining (or alternatively all) incident directions. Thus the DI for a particular (incident) direction, that will be used in the following unless specifically noted otherwise, differs from the, e.g. within the field of hearing aid systems, also generally accepted DI that is independent on a specific direction and as such is determined, from a directional polar pattern, as the ratio (also typically in dB) between the area of a circle with a radius corresponding to the maximum sensitivity compared to the area within the directional polar pattern. Thus an omni-directional polar pattern has a DI of zero (see e.g. the outermost left polar pattern of FIG. 1) while the various cardioids have higher directivity indices.

As mentioned in the introduction, a monaural beamformer used in contemporary hearing aid systems may be realized by providing an omnidirectional signal and a bidirectional signal and combining them to provide a locator signal as already explained and shown in the introduction in equation (1):

$$\text{locator}=\alpha\cdot\text{omni}+(1-\alpha)\cdot\text{bidir} \tag{1}$$

Wherein "locator" represents the output signal provided by the monaural beamformer. It is noted that monaural beamforming in variations may be based on combinations of signal pairs other than omnidirectional and bidirectional signals such as e.g. two cardioids pointing in opposite directions.

As also explained and shown above in the introduction a binaural beamformer may be realized by mixing the monaural beamformer signals from the local and opposite sides of a users head (which in the following also may be denoted ipse-lateral and contra-lateral sides) in accordance with equation (2):

$$\text{BBout}=\beta\cdot\text{loc}_{local}+(1-\beta)\cdot\text{loc}_{opposite} \tag{2}$$

Both equations also form the basis for the present invention. Thus, equation (2) describes the binaurally beamformed signal of one of a pair of hearing aids from a binaural hearing aid system. The other hearing aid will receive an analogously generated signal. Both equations (1) and (2) will in the following unless otherwise noted be considered frequency dependent and consequently also the parameters $\alpha_{local}$, $\alpha_{opposite}$ and $\beta$. According to an embodiment the binaural system comprises a filter bank adapted to provide a plurality of frequency band signals wherefrom the frequency dependence of the beamforming parameters may be determined. However, according to variations the filter bank, the associated frequency bands and the corresponding frequency dependent beamforming parameters may be implemented in alternative ways such as e.g. by using an adaptive filter as will be well known for the skilled person.

It is a particular insight of the inventors that the values of the frequency dependent parameters $\alpha_{local}$, $\alpha_{opposite}$ and $\beta$ may be selected (as part of an optimization) to provide optimized DI values at some predefined incident directions while at the same time maintaining binaural cues.

Generally, it is possible to preserve some amount of spatial cues if $\beta$ is constrained to be larger than 0.5. The closer β is constrained to be to 1, the better the spatial cues will be preserved, but at the cost of a lower DI. Thus according to an embodiment a desired trade-off may be realized by selecting a specific constraint for β.

As discussed in the introduction, a setup in which the monaural beamformer uses α=0.25 and β=0.5 provides a narrow beam at the cost of losing all binaural cues, and furthermore there is a large drop in the DI at 30 degrees.

The present invention enables the DI to be optimized at selected angles such as 0° and 30° while at the same time preserving some binaural cues.

In one example according to the present invention, the following steps are performed in order to provide a binaurally beamformed signal based on the equations (1) and (2) defined above and wherein the directivity index is optimized for at least two directions:

1. Select at least two incident directions ω1, ω2.
2. Calculate the DI for ω1 and for ω2 for at least one frequency range and for every combination of $\alpha_{local}$, $\alpha_{opposite}$ and β. This calculation may employ any mathematical procedure which is appropriate for such an optimization.
3. The result of the calculation will provide the frequency dependent combination of parameters $\alpha_{local}$, $\alpha_{opposite}$ and β which provide the largest value of the sum of the directivity indices for the two selected directions and the considered frequency range. This may include an optimization criterion directed at ensuring that the difference between the directivity indices for the more than one direction is minimized. A further optimization criterion may be directed at ensuring that the directivity index for the forward pointing direction is the largest.
4. Ensure that some binaural cues are preserved either by optimizing the binaural parameter β in at least one frequency range, wherein the DI has not been optimized or by constraining the binaural parameter β, in at least one frequency range, to be larger than a threshold. A specific example will be discussed in the following.

As a specific example a case is considered where the DI is optimized for both 0° and 30° while also preserving binaural cues by putting a constraint on β during the optimization. Thus according to this example DI is optimized as the sum of the DI at 0° and 30° and in this example the constraint is β>0.69. The result of the optimization is given in the table below. The numbers in the table are obtained by calculating the DI at 0° and 30° for every frequency band and every combination of $\alpha_{local}$, $\alpha_{opposite}$ and β and finding the combination that provides the largest DI for the selected frequency bands (i.e. the center frequencies of the frequency bands) angles.

| | Frequency Band | | | | | | | |
|---|---|---|---|---|---|---|---|---|
| | 1 | 2 | 3 | 4 | 5 | 6 | 7 | 8 |
| β | 0.75 | 0.81 | 0.75 | 0.69 | 0.69 | 0.69 | 0.69 | 0.75 |
| $\alpha_{local}$ | 0.13 | 0.25 | 0.25 | 0.31 | 0.31 | 0.31 | 0.19 | 0.19 |
| $\alpha_{opposite}$ | 0.5 | 0.5 | 0.5 | 0.5 | 0.5 | 0.31 | 0 | 0 |

| | Frequency Band | | | | | | |
|---|---|---|---|---|---|---|---|
| | 9 | 10 | 11 | 12 | 13 | 14 | 15 |
| β | 0.88 | 0.81 | 0.75 | 0.69 | 0.69 | 0.81 | 0.69 |
| $\alpha_{local}$ | 0.25 | 0.19 | 0.19 | 0.19 | 0.19 | 0.19 | 0.25 |
| $\alpha_{opposite}$ | 0.06 | 0.19 | 0.06 | 0.13 | 0.13 | 0.19 | 0.13 |

Figure 2:
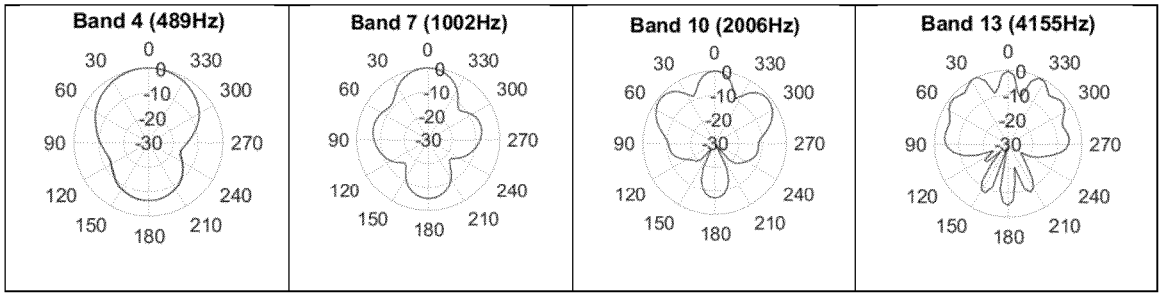
FIG. 2 illustrates directional polar patterns provided by a binaural beamformer of a conventional hearing aid system for a plurality of frequencies.
Figure 4:
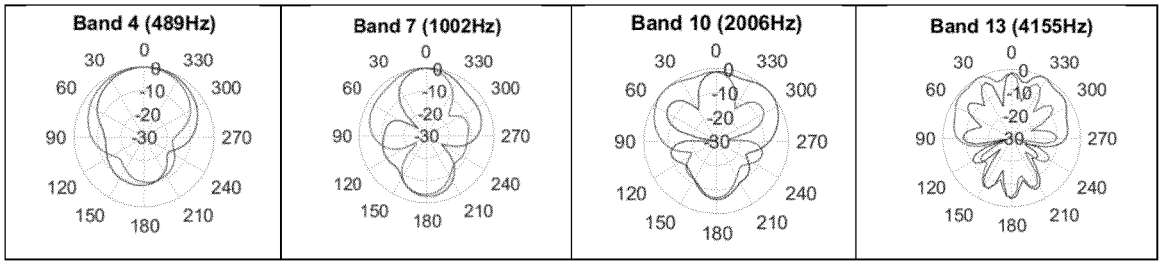
FIG. 4 illustrates directional polar patterns provided by a binaural beamformer of a hearing aid system according to the invention for a plurality of frequencies.
Figure 3:
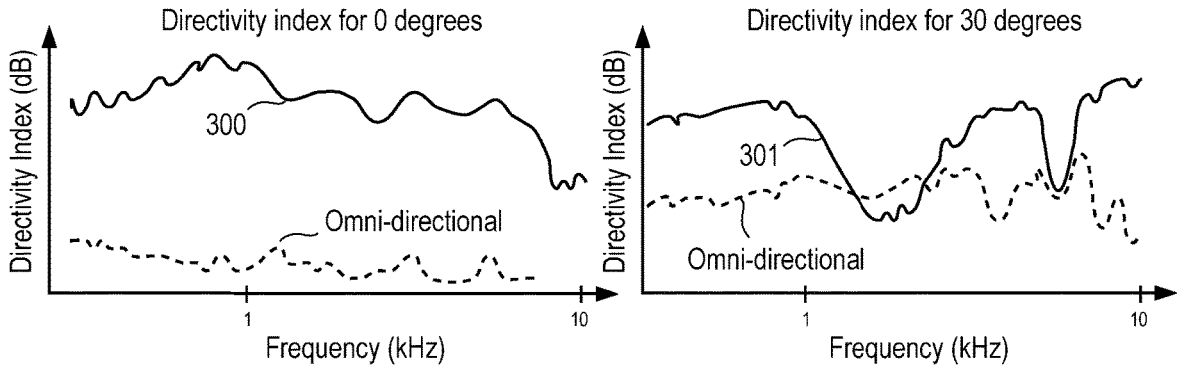
FIG. 3 illustrates directivity index as a function of frequency provided by a binaural beamformer of a conventional hearing aid system for two different directions.
Figure 5:
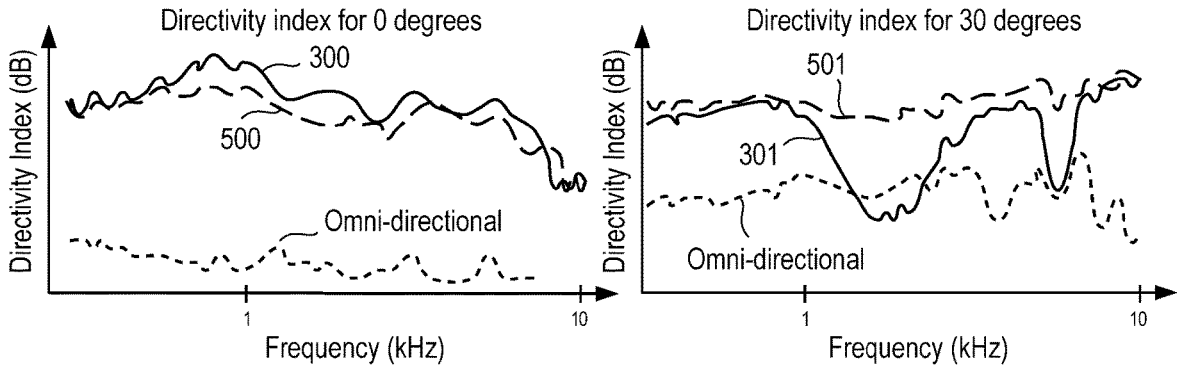
FIG. 5 illustrates directivity index as a function of frequency provided by a binaural beamformer of a hearing aid system according to the invention for two different directions.

The performance of the binaural beamforming obtained with the optimized parameter set given in the table above are illustrated in FIG. 4 and FIG. 5. FIG. 4 illustrates a directional polar pattern in accordance with the present invention and obtained with an ear level audio system positioned on a manikin for testing of hearing aid systems (such a manikin is often denoted a Kemar) and when compared with FIG. 2 it can be seen, that the decrease in sensitivity at 30°, which is present in FIG. 2, most notably in the frequency band around 2 kHz, has disappeared in FIG. 4 for the halfplane pointing away from the users head. This is also clearly visible for the directivity index at 30° obtained with the optimized parameter set as given in the table above and as illustrated by the curve 501 in FIG. 5.

The directional polar patterns in FIG. 4 also show that binaural cues have returned. Especially in the frontal plane the difference in sensitivity for the left and right side is now clearly visible, which will provide the user with binaural cues. For example, in the frequency band of 2 kHz the directional polar pattern for the left side (dashed line) clearly shows a higher sensitivity on the left side, whereas the opposite is the case for the right side (dotted line). These directional polar patterns also illustrate that the sensitivity is higher towards the frontal direction compared to the rear direction.

According to an embodiment the strength of the binaural cues are optimized for at least one binaural cue frequency range below a frequency threshold in the range between 500 Hz and 3 kHz, while at least one directivity index is optimized for a frequency range above said frequency threshold. According to a variation the binaural beamformer is fixed below said frequency threshold in the range between 500 Hz and 3 kHz and adaptive above. According to a more specific variation the strength of the binaural cues below the frequency threshold is optimized by providing directional polar patterns that are adapted to provide a lower sensitivity for sounds incident from the direction towards the other ear of the user as opposed to sounds incident from the directly opposite direction, whereby the binaural cues in the form of interaural level differences are optimized.

In summary, the optimization according to the present invention provides a balanced combination of optimized directivity and binaural cues.

Figure 6:
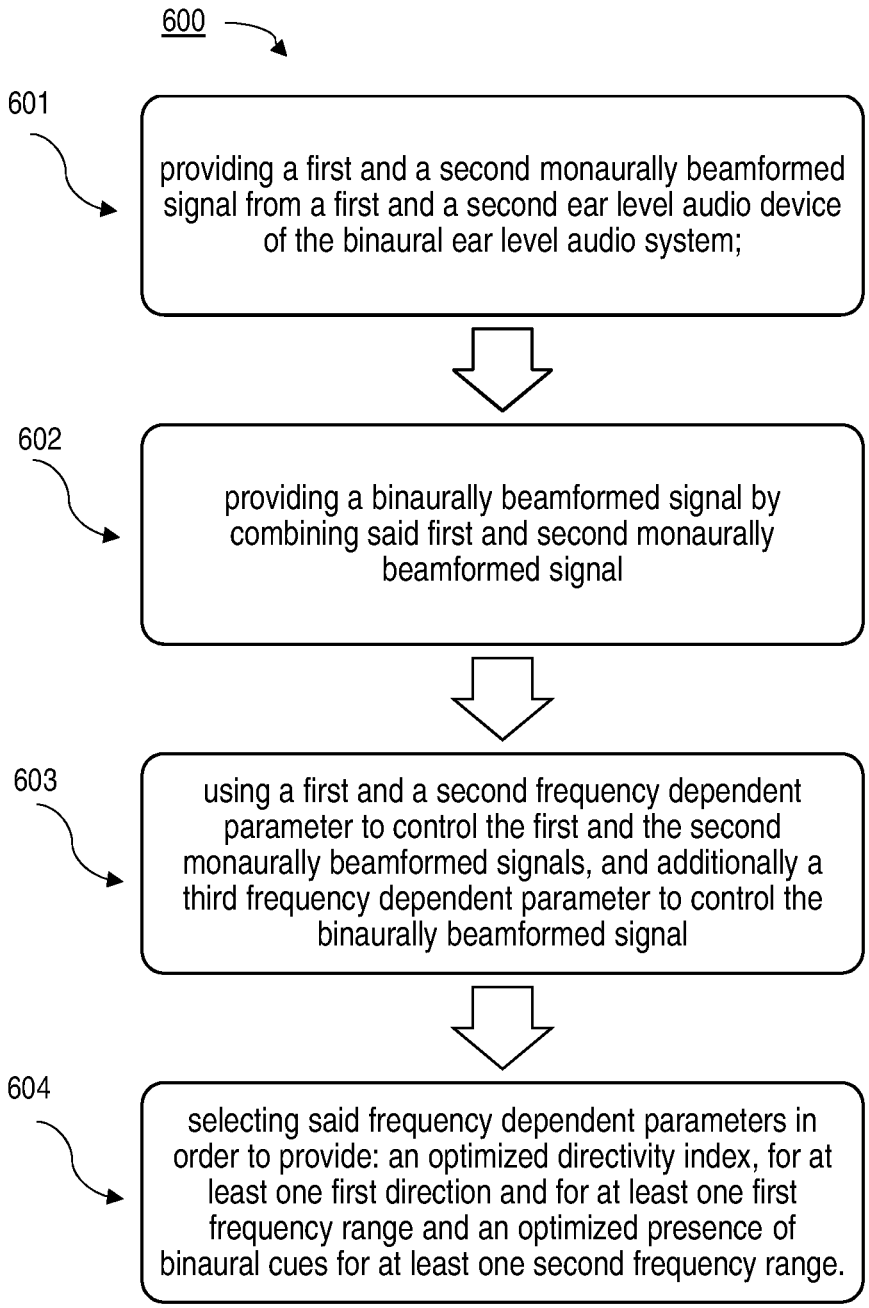
FIG. 6 illustrates highly schematically a method of operating a binaural ear level audio system according to an embodiment of the invention.

Reference is now given to FIG. 6, which illustrates highly schematically a method 600 of operating a binaural ear level audio system according to an embodiment of the invention.

The first step 601 of the method comprises providing a first and a second monaurally beamformed signal from a first and a second ear level audio device of the binaural ear level audio system;

The second step 602 of the method comprises providing a binaurally beamformed signal by combining said first and second monaurally beamformed signal;

The third step 603 of the method comprises using a first and a second frequency dependent parameter to control the first and the second monaurally beamformed signals, and additionally a third frequency dependent parameter to control the binaurally beamformed signal The fourth step 604 of the method comprises selecting said frequency dependent parameters in order to provide: an optimized directivity index, for at least one first direction and for at least one first frequency range and an optimized presence of binaural cues for at least one second frequency range.

According to a variation of the present invention, a personalization procedure may be carried out as part of an initial fitting or as part of a subsequent fine tuning. Initially the personalization procedure will test, for a plurality of sound environments, how much the speech intelligibility depends on the availability of binaural cues as opposed to having a high DI for a given range of specific directions (typically primarily towards the frontal halfplane). Based on the result of these tests an optimum trade off between directivity and binaural cues can be obtained by optimizing the parameter set required for binaural beam forming parameters (i.e. $\alpha_{local}$, $\alpha_{opposite}$ and $\beta$).

According to a more specific variation of the present invention the impact of the availability of binaural cues, as opposed to having a high DI with respect to speech intelligibility for an individual user is determined by testing the users speech intelligibility in various sound environments. This may include an optimization criterion directed at ensuring that the difference between the directivity indices for the more than one direction is minimized. A further optimization criterion may be directed at ensuring that the directivity index for the forward pointing direction is the largest.

According to an even more specific variation this process of finding the optimum binaural beam forming parameters for the individual user with respect to speech intelligibility may be carried out using the methods disclosed in WO-A1-2016004983 by the same applicant. More specifically reference may be given to the method steps of claim 1 as given in page 22, line 1—page 23, line 4 of the referenced document, with the minor adjustment that instead of the user providing a rating of her preference for either of two sounds differing with respect to a set of parameters then according to this specific variation the speech intelligibility for the user is determined for each of such two sounds to be compared and based hereon a relative rating is obtained that may be used directly in the method of the referenced document.

However, according to another specific variation this process of finding the optimum binaural beam forming parameters for the individual user may also be carried out using the methods disclosed in WO-A1-2016004983 but based simply on the users preferences when comparing optimized settings based on e.g. different selected at least first and second directions and/or different weighting of the optimized directivity indices compared to the maintenance of the binaural cues.

According to an even more specific variation, the individualization procedure is based on a measurement of the amount of cognitive resources required by the user with the different parameter settings and in various sound environments. More specifically the required amount of cognitive resources may according to a variation be determined using Electroencephalography (EEG) monitoring equipment.

According to yet another advantageous aspect the individualization procedure includes testing in various sound environments that at least differ in the number and positions of present talkers.

According to a specific embodiment the term binaural cues may be interpreted as the same as the interaural level difference.

According to an embodiment said at least first and second directions for which directivity is optimized are selected adaptively and automatically based on direction of arrival (i.e. DOA) methods, e.g. by using the specific methods disclosed in WO-A1-2019086435 or WO-A1-2019086439 by the same applicant. More specifically reference may be given to the method steps of claim 1 for the two patent applications.

It is generally noted that even though many features of the present invention are disclosed in embodiments comprising other features then this does not imply that these features by necessity need to be combined.

As one example the various disclosed features for individualizing a system according to the invention such as using EEG monitoring and using the methods disclosed in WO-A1-2016004983—is generally independent of the specific values selected for the binaural beamforming parameters $\alpha_{local}$, $\alpha_{opposite}$ and $\beta$.

Other modifications and variations of the structures and procedures will be evident to those skilled in the art.

The invention claimed is:

1. A method of operating a binaural ear level audio system comprising the steps of:

providing a first and a second monaurally beamformed signal from a first and a second ear level audio device of the binaural ear level audio system;

providing a binaurally beamformed signal by combining said first and second monaurally beamformed signal;

using a first and a second frequency dependent parameter to control the first and the second monaurally beamformed signals, and additionally a third frequency dependent parameter to control the binaurally beamformed signal wherein said frequency dependent parameters are selected in order to provide an optimized directivity index, for at least one first direction and for at least one first frequency range and an optimized presence of binaural cues for at least one second frequency range;

wherein said frequency dependent parameters are selected in order to provide optimized directivity indices, for at least two directions and for at least one first frequency range and an optimized presence of binaural cues for at least one second frequency range; and wherein said first frequency range is below a frequency threshold and wherein said second frequency range is above the frequency threshold and wherein the frequency threshold is in the range between 500 Hz and 3 kHz.

2. The method of operating a binaural ear level audio system of claim 1, wherein the directivity indices for said at least two directions are optimized by determining the maximum sum of said at least two directivity indices.

3. A method of operating a binaural ear level audio system comprising the steps of:

providing a first and a second monaurally beamformed signal from a first and a second ear level audio device of the binaural ear level audio system;

providing a binaurally beamformed signal by combining said first and second monaurally beamformed signal;

using a first and a second frequency dependent parameter to control the first and the second monaurally beamformed signals, and additionally a third frequency dependent parameter to control the binaurally beamformed signal wherein said frequency dependent parameters are selected in order to provide: an optimized directivity index, for at least one first direction and for at least one first frequency range and an optimized presence of binaural cues for at least one second frequency range;

wherein the values of the third frequency dependent parameter are constrained during the optimization in order to ensure that the binaurally beamformed signal is different in the two ear level audio devices and to ensure that the ipse-lateral part of the binaurally beamformed signal is weighted higher than the contra-lateral part.

4. A binaural ear level audio system comprising a first ear level audio device and a second ear level audio device and wherein at least one of the first and the second ear level audio device comprises a digital processor adapted to perform the method of claim 1.

5. The binaural ear level audio system according to claim 4, wherein the binaural ear level audio system is a binaural hearing aid system.

6. A computer program product with instructions which, when executed on a computer, perform the method of claim 1.

7. A method of operating a binaural ear level audio system comprising the steps of:

providing a first and a second monaurally beamformed signal from a first and a second ear level audio device of the binaural ear level audio system;

providing a binaurally beamformed signal by combining said first and second monaurally beamformed signal;

using a first and a second frequency dependent parameter to control the first and the second monaurally beamformed signals, and additionally a third frequency dependent parameter to control the binaurally beamformed signal;

wherein said frequency dependent parameters are selected in order to provide: an optimized directivity index, for at least one first direction and for at least one first frequency range and an optimized presence of binaural cues for at least one second frequency range;

wherein said frequency dependent parameters are selected in order to provide optimized directivity indices, for at least two directions and for at least one first frequency range and an optimized presence of binaural cues for at least one second frequency range; and wherein the directivity indices for said at least two directions are optimized by determining the maximum sum of said at least two directivity indices.

* * * * *